US005829398A

United States Patent [19]

Strauss et al.

[11] Patent Number: 5,829,398

[45] Date of Patent: Nov. 3, 1998

[54] VALVE TIMING CONTROL DEVICE FOR GAS EXCHANGE VALVES ON AN INTERNAL COMBUSTION ENGINE

[75] Inventors: Andreas Strauss, Herzogenaurach; Eduard Golovatai-Schmidt, Rottenbach; Martin Scheidt, Adelsdorf, all of Germany

[73] Assignee: INA Walzlager Schaeffler KG, Germany

[21] Appl. No.: 734,969

[22] Filed: Oct. 23, 1996

[30] Foreign Application Priority Data

Nov. 9, 1995 [DE] Germany ..... 195 41 703.8

[51] Int. Cl.[6] ..... F01L 1/344

[52] U.S. Cl. ..... 123/90.17; 123/90.31; 74/568 R; 464/2

[58] Field of Search ..... 123/90.15, 90.17, 123/90.31; 74/567, 568 R; 464/1, 2, 160

[56] References Cited

U.S. PATENT DOCUMENTS 5,012,774 5/1991 Strauber et al. ..... 123/90.17

5,435,782 7/1995 Tortul ..... 123/90.17

5,588,404 12/1996 Lichti et al. ..... 123/90.17

*Primary Examiner*—Weilun Lo

*Attorney, Agent, or Firm*—Bierman, Muserlian and Lucas

[57] ABSTRACT

A valve timing control device (1) for varying opening and closing times of gas exchange valves of an internal combustion engine, characterized in that, in at least one of the pressure chambers (5, 6), there is arranged at least one spring means (13) whose spring force acts on the adjusting piston (4) to counteract an undesired adjusting direction (delayed opening and closing times $t_{N+}$) of the adjusting piston (4) caused by a drag and frictional torque $M_S$ of the camshaft (2) during operation of the internal combustion engine, whereby the drag and frictional torque $M_S$ in a low-speed, low-load range of the internal combustion engine is substantially counteracted by an oppositely directed torque $M_F$ obtained from the spring force of the spring means (13).

5 Claims, 2 Drawing Sheets

Fig. 1A
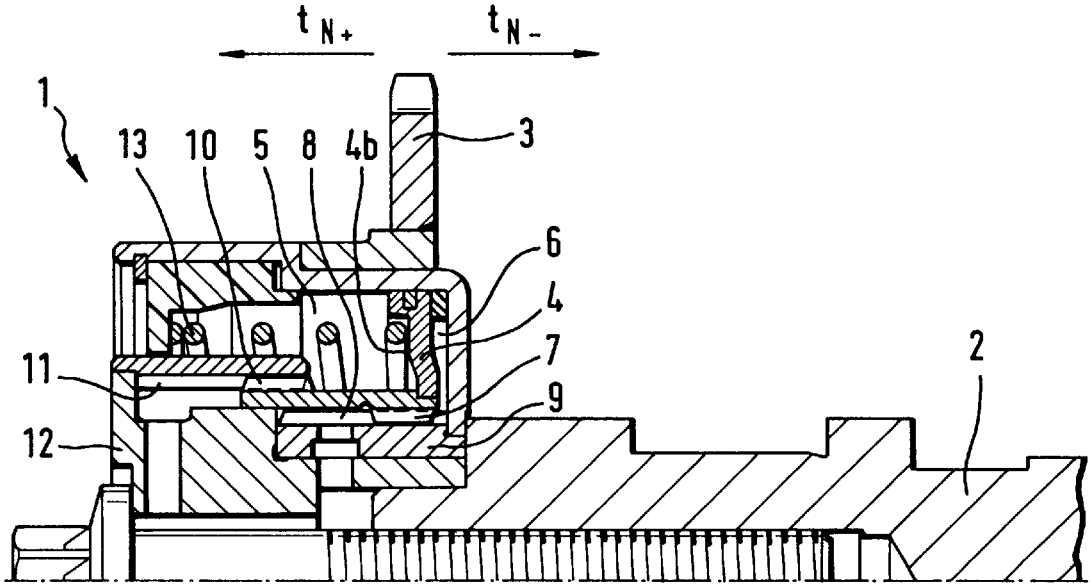
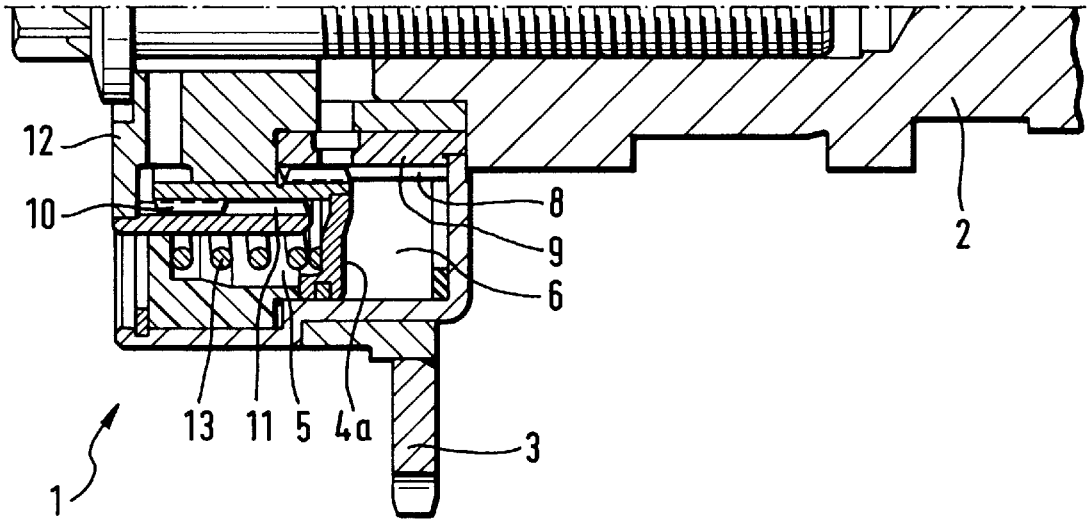
Fig. 1B
Fig. 1

VALVE TIMING CONTROL DEVICE FOR GAS EXCHANGE VALVES ON AN INTERNAL COMBUSTION ENGINE

FIELD OF THE INVENTION

The invention concerns a valve timing control device for varying opening and closing times of gas exchange valves of an internal combustion engine, the device being arranged on a drive pinion within a timing gear of at least one intake or exhaust camshaft mounted in a cylinder head, with which camshaft the drive pinion is in driving relationship, said device comprising an adjusting piston which is axially displaceable to and fro by hydraulic medium, said adjusting piston comprising first and second oppositely oriented helical gear sections, and the first of said gear sections cooperates with a corresponding gearing of a driving element connected to the drive pinion, while the second of said gear sections cooperates with a corresponding gearing of a driven element connected to the camshaft, the adjusting piston having a first and a second end face which delimit a first and a second hydraulic medium pressure chamber, a selective pressurizing of the first or of the second pressure chamber by hydraulic medium causing an axial displacement of the adjusting piston in a direction to delay or to advance opening and closing times of the gas exchange valves concerned.

BACKGROUND OF THE INVENTION

A valve timing control device of the above type is known from EP-OS 0 469 332. As can be seen in FIG. 1*a* of this document, the adjusting piston 34 is displaced by the pressure exerted thereon by hydraulic fluid from pressure chambers 41, 40 arranged on either side of the piston. A disadvantage of this generic prior art device is that it provides no measures for the equalization of the varying adjusting speeds of the adjusting piston caused by the drag and frictional torques of the camshaft which act to vary the valve timing to "a delaying side". Since these drag and frictional torques are at their highest at low engine speeds accompanied by high hydraulic medium temperatures, it is under such conditions that the problems discussed above are the most serious.

An explanation for the relatively high drag and frictional torques at low engine speeds is that, for the most part, the friction pairs in the valve drive (e.g. camshaft mounting region) are still subjected to mixed friction in this speed range. At the same time, a high lubricant temperature lowers the viscosity of the lubricant which results in the formation of only a relatively poorly defined lubricant wedge so that the lubricant film in the friction pairs is also very thin. Actually, hydraulically loading the adjusting piston from both sides does permit the obtention of the desired high adjusting speeds but in the case of the prior art device, it is difficult to obtain these high speeds of adjustment precisely when they are particularly desirable i.e., when hydraulic pressure is low due to low engine speeds and/or high hydraulic medium temperature.

OBJECTS OF THE INVENTION

It is an object of the invention to provide an improved valve timing control device which eliminates the aforesaid disadvantages of the prior art and permits, in a broad range, particularly in the low speed range of the engine, the greatest possible equalization of the varying adjusting speeds of the adjusting piston caused by the drag and frictional torques of the camshaft which act to vary the valve timing to a "delaying side".

This and other objects and advantages of the invention will become obvious from the following detailed description.

SUMMARY OF THE INVENTION

The invention achieves this object by the fact that, in at least one of the pressure chambers, there is arranged at least one spring means whose spring force acts on the adjusting piston to counteract an undesired adjusting direction (delayed opening and closing times $t_{N+}$) of the adjusting piston caused by a drag and frictional torque $M_S$ of the camshaft during operation of the internal combustion engine, so that the drag and frictional torque $M_S$ in a low-speed, low-load range of the internal combustion engine is substantially counteracted by an oppositely directed torque $M_F$ obtained from the spring force.

For the use of the spring means of the invention in an adjusting device for an intake camshaft, the spring means of the invention is designed so as to establish the following expression:

$$M_{NU} \leqq M_F \leqq M_{NO}$$

wherein $M_F$ is the torque transmitted by the spring means through the adjusting piston to the camshaft, $M_{NO}$ is the drag and frictional torque of the camshaft at an engine speed $n_{L1}$ which is ≈200 rpm higher than the idling speed $n_L$ of the engine at a hydraulic medium temperature of about 150° C., and $M_{NU}$ is the drag and frictional torque $M_S$ of the camshaft at an engine speed $n_{L2}$ which is ≈1,500 rpm higher than the idling speed of the engine at a hydraulic medium temperature of about 90° C.

This enables the obtention of almost constant adjusting speeds of the adjusting piston in the critical lower speed range at the relevant hydraulic medium temperatures from 90° to 150° C. Thus, although in this case, the spring means likewise acts in opposition to the desired basic adjusted position of the adjusting piston in the idling phase, the spring torque is overcome by the drag and frictional torque of the camshaft in this speed range. When using the spring means in an adjusting device for an exhaust camshaft, $M_{NO}$ can be made to apply at the idling speed $n_L$ of the engine. This feature likewise falls in the scope of protection of the invention.

By the use of the aforesaid spring means which counteracts in a controlled manner, the drag and frictional torques of the camshaft which vary valve timing to a "delaying" side, almost constant adjusting speeds of the adjusting piston can be obtained, particularly in the critical lower speed range of the internal combustion engine. The spring means is designed at the same time so as to assure starting and emergency running positions of the camshaft depending on the particular function of the adjusting device in each case i.e., whether the camshaft is an intake or an exhaust camshaft.

If the spring means is integrated in an adjusting device for an intake camshaft, a position of the camshaft in a direction of "delayed" opening and closing of the intake valves is desirable in any case for starting the engine. For such a use, the spring means is therefore designed so that the torque produced by it to act on the adjusting piston is smaller than the "delaying" drag and frictional torques of the camshaft in the idling range of the engine so that the starting and emergency running position of the device is thus assured. Consequently, in the low-speed range under consideration, only a small valve overlap of the intake and exhaust valves with a small amount of residual gas content in the cylinder is produced.

When using such a spring means in an adjusting device for an exhaust camshaft, a small valve overlap can likewise be obtained by designing the spring means so that it overcomes the drag and frictional torque of the camshaft already in the idling range.

The spring means of the invention can be, for example, a compression spring. In the present embodiment, it is preferably a helical compression spring arranged concentrically with the camshaft. It is also possible to use other spring elements and to integrate them in the device coaxially with the camshaft.

BRIEF DESCRIPTION OF THE DRAWINGS

FIG. 1A is a longitudinal cross-section through a device having a compression spring of the invention (upper semi-section);

FIG. 1B is a longitudinal cross-section through a device having a compression spring of the invention (lower semi-section);

FIGS. 1A and 1B show a valve timing control device 1 for gas exchange valves of an internal combustion engine. The structure and mode of operation of such a device will not be dealt with here because these are sufficiently well known in the technical field.

Figure 2:
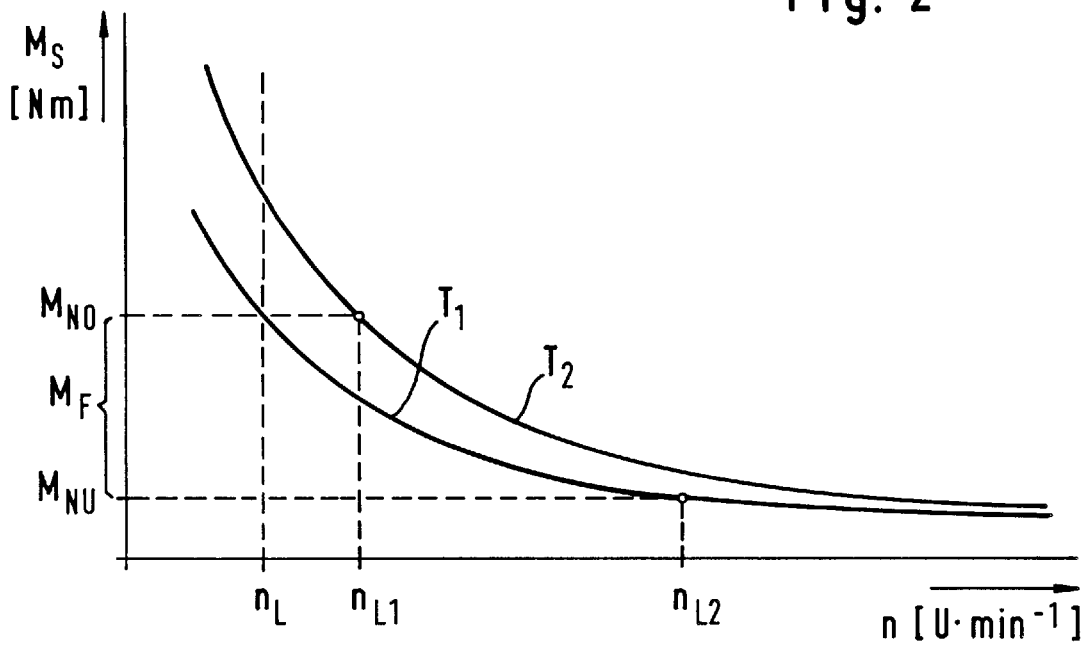
FIG. 2 is a diagram showing the drag torques of the camshaft plotted against the engine speed with isotherms $T_1$ and $T_2$.

In this example of embodiment, the device 1 is associated to an intake camshaft 2 of a valve drive and a drive pinion 3 is entrained by a traction means, not shown, which cooperates with a crankshaft of the internal combustion engine. The device 1 is of, in itself, a known type and is arranged between the drive pinion 3 and the camshaft 2. An adjusting piston 4 which can be moved axially to and fro by hydraulic medium is arranged in the interior of the device 1 and defines pressure chambers 5 and 6 for hydraulic medium. The adjusting piston 4 comprises a first inner helical gear section 7 meshing with an outer gearing 8 of a driving element 9 which cooperates with the drive pinion 3. The adjusting piston 4 further comprises an outer helical gear section 10 which meshes with a corresponding inner gearing 11 of a driven element 12 connected to the camshaft 2. A supply of hydraulic medium to the pressure chamber 6, for instance, causes the adjusting piston 4 to be displaced towards the pressure chamber 5. Due to the meshed gearings 7, 8 and 10, 11, this displacement results in a rotation of the camshaft 2 relative to the drive pinion 3 by which it is driven.

A spring means 13 in the form of a compression spring is arranged concentric with the device within the pressure chamber 5. Since, as already described, the drag and frictional torque $M_S$ of the camshaft 2 always acts to vary the valve opening and closing times to a "delaying side", the adjusting piston of the device has a tendency to be displaced, as mentioned in the preceding paragraph, towards the pressure chamber 5. Thus, if the pressure in the hydraulic chamber 5 is increased with the aim of adjusting the camshaft 2 toward the "advancing side", this adjusting process would be delayed by the drag and frictional torque $M_S$ of the camshaft 2. The invention therefore provides for the force of the spring means 13 to be dimensioned so that the spring means 13 imparts a controlled counter-torque $M_F$ to the adjusting piston 4 at least in the critical lower speed range of the internal combustion engine (see FIG. 2).

FIG. 2 shows that the torque $M_F$ obtained from the spring force is selected so that it is overcome by the drag and frictional torque $M_S$ of the camshaft 2 at an idling speed $n_L$ of the engine. This is required when the device 1 is used with an intake camshaft to obtain the desired small valve overlap (delayed opening and closing of the intake valves) even without engine oil pressure. It is only when an engine speed $n_{L1}$ is reached, which, for instance, is 200 higher than the idling speed, that the torque $M_F$ from the force of the spring means 13 becomes larger than the drag and frictional torque $M_S$ of the camshaft 2 at a hydraulic medium temperature of 150° C. (see isotherm $T_2$). The second limit value for choosing the torque $M_F$ obtained from the spring force of the spring means 13 is determined by a speed $n_{L2}$ of the engine which is 1,500 rpm higher than the idling speed $n_L$ of the engine at a hydraulic medium temperature of, for example, 90° C. (see isotherm $T_1$).

As FIG. 2 shows, the force of the spring means 13 of the invention is chosen so that the torque $M_F$ of the spring means 13 which acts on the adjusting piston 4 is situated in the range between $M_{NO}$ and $M_{NU}$. Due to this configuration, the adjusting piston 4 acts with almost constant adjusting speeds in both directions of adjustment (delayed or advanced opening of the gas exchange valves) in the aforesaid engine speed range of relatively high drag and frictional torques $M_S$ of the camshaft 2.

The invention equally concerns a spring means 13 integrated in a device 1 for adjusting an exhaust camshaft. In this case, the spring means 13 is designed so that its spring force produces a torque $M_F$ which, already at the idling speed $n_L$ of the engine, is larger than the occurring upper drag and frictional torque $M_{NO}$ of the camshaft 2 at a hydraulic medium temperature of, for instance, 150° C. This configuration of the force of the spring means 13 is necessary in the case of an exhaust camshaft because for starting the engine, an "advanced" opening and closing of the exhaust valves is required at the idling speed $n_L$ for a small valve overlap $\ddot{U}_V$ is. Such a force of the spring means 13 leads at the same time to the creation of an emergency running feature in the device 1 for the camshaft 2.

Figure 3:
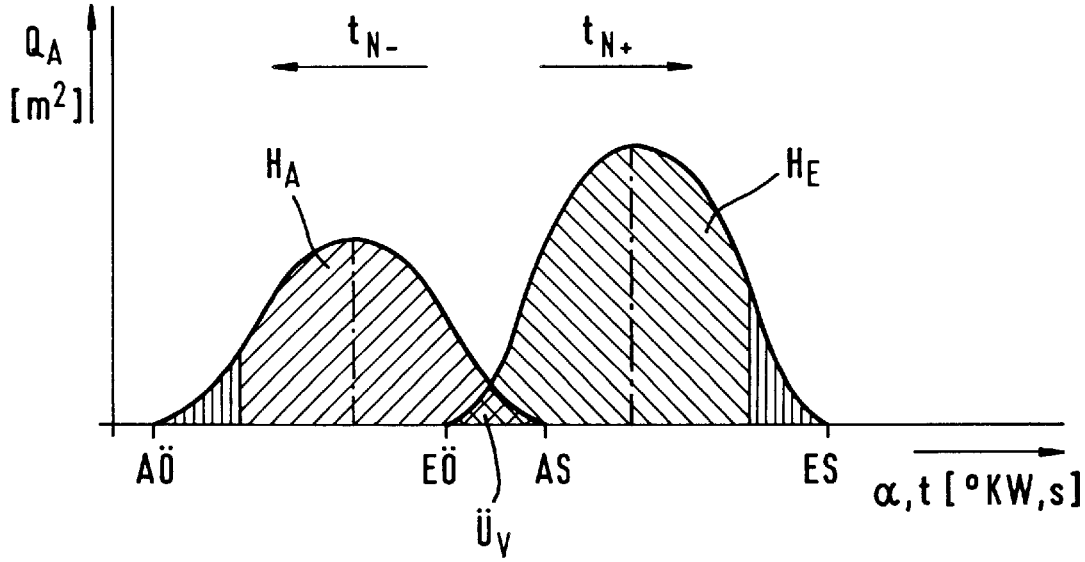
FIG. 3 is a timing diagram of a four-stroke engine.

Finally, FIG. 3 shows a timing diagram of a four-stroke engine in which the gas exchange cycles and the valve overlap $\ddot{U}_V$ are clearly to be seen.

It is understood that the invention also includes valve drives in which both the intake and the exhaust camshaft(s) comprise the device 1.

Various modification of the device of the invention may be made without departing from the spirit or scope thereof and it is to be understood that the invention is intended to be limited only as defined in the appended claims.

We claim:

1. A valve timing control device (1) for varying opening and closing times of gas exchange valves of an internal combustion engine, the device being arranged on a drive pinion (3) within a timing gear of at least one intake or exhaust camshaft mounted in a cylinder head, with which camshaft (2) the drive pinion (3) is in driving relationship, said device (1) comprising an adjusting piston (4) which is axially displaceable to and fro by hydraulic medium, said adjusting piston (4) comprising first and second oppositely oriented helical gear sections (7, 10), and the first of said gear sections (7) cooperates with a corresponding gearing (8) of a driving element (9) connected to the drive pinion (3), while the second of said gear sections (10) cooperates with a corresponding gearing (11) of a driven element (12) connected to the camshaft (2), the adjusting piston (4) having a first and a second end face **(4*a*, 4*b*) which delimit a first and a second hydraulic medium pressure chamber (5,**

6), a selective pressurizing of the first or of the second pressure chamber (5 or 6) by hydraulic medium causing an axial displacement of the adjusting piston (4) in a direction to delay or to advance opening and closing times of the gas exchange valves concerned, characterized in that, in at least one of the pressure chambers (5, 6), there is arranged at least one spring means (13) whose spring force acts on the adjusting piston (4) to counteract an undesired adjusting direction of delayed opening and closing times $t_{N+}$ of the adjusting piston (4) caused by a drag and frictional torque $M_S$ of the camshaft (2) during operation of the internal combustion engine, wherein the drag and frictional torque $M_S$ in a low-speed, low-load range of the internal combustion engine is substantially counteracted by an oppositely directed torque $M_F$ obtained from the spring force of the spring means (13).

2. A valve timing device of claim 1 wherein the spring force of the spring means (13) is chosen so that the following expression is established for the torque $M_F$ transmitted by the spring means (13) through the adjusting piston (4) to the camshaft (2):

$$M_{NU} \leqq M_F \leqq M_{NO}$$

wherein $M_{NO}$ is the drag and frictional torque of the camshaft at an engine speed $n_{L1}$ which is ≈200 higher than an idling speed $n_L$ of the engine at a hydraulic medium temperature of about 150° C., and $M_{NU}$ is the drag and frictional torque $M_S$ of the camshaft at an engine speed $n_{L2}$ which is ≈1,500 rpm higher than the idling speed of the engine at a hydraulic medium temperature of about 90° C.

3. A valve timing device of claim 1 wherein the spring means (13) is a compression spring.

4. A valve timing device of claim 2 wherein the spring means (13) is a compression spring.

5. A valve timing device of claim 1 wherein the spring means (13) extends concentrically with a longitudinal axis of the camshaft (2) and annularly surrounds the gear sections (7, 10) of the adjusting piston (4).

* * * * *